US005642879A

United States Patent [19]

Rodriguez

[11] Patent Number: 5,642,879

[45] Date of Patent: Jul. 1, 1997

[54] SPORTS PRACTICE APPARATUS

[76] Inventor: Diego Rodriguez, 135 Sunglo, San Antonio, Tex. 78221

[21] Appl. No.: 659,094

[22] Filed: Jun. 4, 1996

[51] Int. Cl.[6] ..... A63B 69/00

[52] U.S. Cl. ..... 473/448; 248/910

[58] Field of Search ..... 273/1.5 R, 1.5 A, 273/411; 248/910

[56] References Cited

U.S. PATENT DOCUMENTS

| | | | |
|---|---|---|---|
| 3,602,504 | 8/1971 | Chapman et al. | 273/411 X |
| 3,752,476 | 8/1973 | Mahoney | 273/1.5 A |
| 3,836,144 | 9/1974 | Mahoney | 273/1.5 A |
| 4,357,019 | 11/1982 | Wouters | 273/411 |
| 4,720,112 | 1/1988 | Stettner et al. | 273/411 |
| 4,838,549 | 6/1989 | Woodall | 273/1.5 A |
| 4,852,511 | 8/1989 | Look et al. | 248/910 X |
| 4,913,383 | 4/1990 | McCant | 248/910 X |
| 5,160,138 | 11/1992 | Sanders | 273/1.5 A |
| 5,312,099 | 5/1994 | Oliver, Sr. | 273/1.5 A |
| 5,485,993 | 1/1996 | Lipsett | 273/1.5 A |
| 5,505,443 | 4/1996 | Padilla | 273/411 X |
| 5,527,185 | 6/1996 | Davis | 273/1.5 A |

FOREIGN PATENT DOCUMENTS

| | | | |
|---|---|---|---|
| 2708474 | 2/1995 | France | 273/1.5 A |
| 908055 | 10/1962 | United Kingdom | 273/1.5 R |

OTHER PUBLICATIONS

KBA Basketball Coaching and Training Aids 1989 School Mail Order Catalog, p. 16, Master Excel/Playmaker Excell.

*Primary Examiner*—Paul E. Shapiro

*Attorney, Agent, or Firm*—David L. Volk; Brendan B. Dix

[57] ABSTRACT

Two net support assemblies each comprise a sleeve and a telescoping member configured to slidingly fit within the sleeve. A net is configured to be stretched between the net support assemblies. The sleeves are each separably attachable to a plate such that the sleeves and the telescoping members extend substantially upwardly from the plate when the apparatus is assembled and ready for use. A floor stand assembly is separably attachable to the plate. A sand bag is separably attachable to the plate to provide stability to the apparatus.

4 Claims, 2 Drawing Sheets

SPORTS PRACTICE APPARATUS

BACKGROUND—FIELD OF INVENTION

This invention relates to sports education and practice devices, specifically to an apparatus for practicing basketball shots.

BACKGROUND—DESCRIPTION OF PRIOR ART

When practicing basketball, a particularly important maneuver to learn is a shot toward the basket with a high arc that escapes the reach of a tall, jumping defender. What is needed is an apparatus which can simulate the blocking effect of a jumping defender. A player could learn to make high arcing shots by continually taking practice shots over such a device. It would be advantageous if such a device were inexpensive, easy to assemble and disassemble for storage and transport, and adjustable in height to vary the difficulty of shots based on the needs and abilities of the user.

SUMMARY

The sports practice apparatus of the present invention includes two net support assemblies for stretching a net there-between. The net support assemblies each comprise a sleeve and a telescoping member configured to slidingly fit within the sleeve. The sleeves are each separably attachable to a plate such that the sleeves and the telescoping members extend substantially upwardly from the plate when the apparatus is assembled and ready for use. A floor stand assembly is separably attachable to the plate. A sand bag is separably attachable to the plate to provide stability to the apparatus.

DETAILED DESCRIPTION

Figure 1:
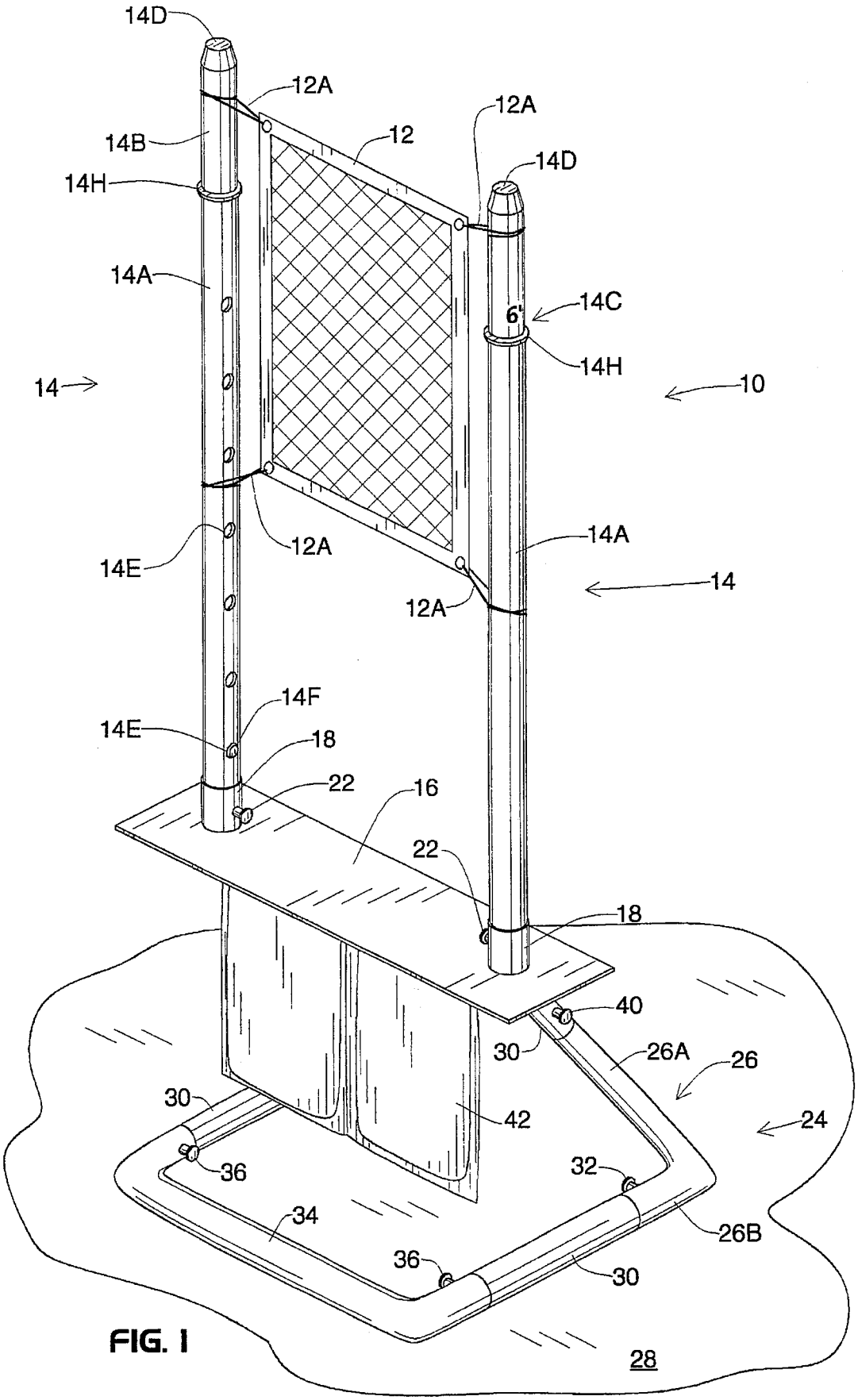
FIG. 1 is a perspective view of the sports practice apparatus.
Figure 2:
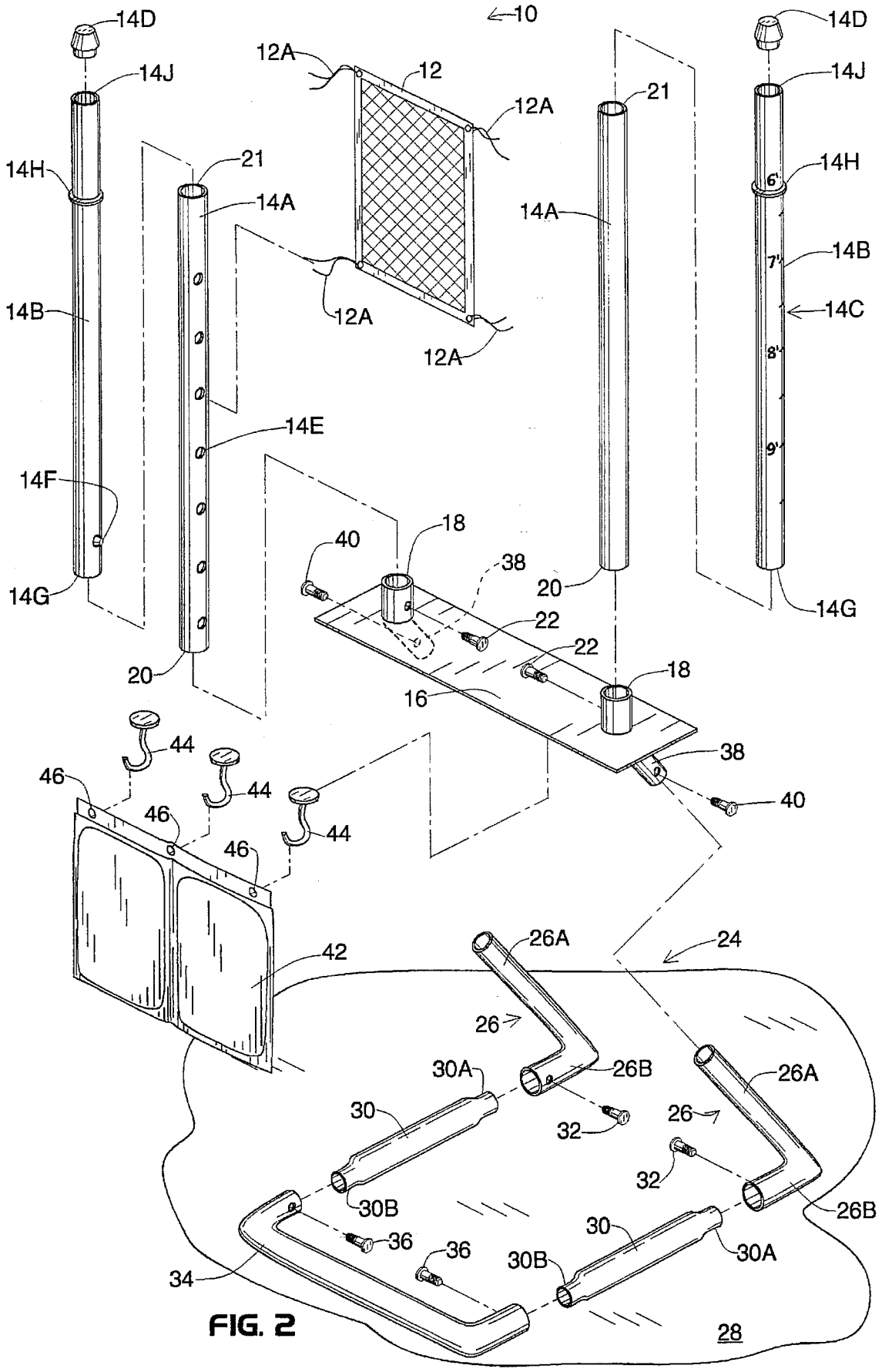
FIG. 2 is an exploded view of the sports practice apparatus.

FIG. 1 is a perspective view of a sports practice apparatus 10, and FIG. 2 is an exploded view thereof. Reference is had to both views throughout this description. The basketball practice apparatus 10 is intended for a player (not shown) to practice shots over a net 12. The net 12 is stretched between two net support assemblies 14 and tied to the net support assemblies 14 via tying members 12A when the practice apparatus 10 is assembled and ready for use. The net support assemblies 14 each comprise a cylindrical sleeve 14A and a cylindrical telescoping member 14B, configured to slidingly fit within the sleeve 14A. When the practice apparatus 10 is assembled and ready for use, the net support assemblies 14 are disposed in a substantially vertical position.

The sleeves 14A each include structure forming holes 14E disposed longitudinally along the sleeve 14A. The holes 14E are sized to receive a spring-loaded button 14F attached proximate a first end 14G of the telescoping member 14B. The configuration and use of the holes 14E and the button 14F are well known in the prior art as a means of providing adjustability, and so the configuration of the button 14F is not disclosed herein.

Each of the telescoping members 14B has a stop ring 14H disposed annularly about the telescoping member 14B. The stop ring 14H has an outer diameter larger than the inner diameter of the sleeve 14A, to limit travel of the telescoping member 14B into the sleeve 14A.

The telescoping members 14B each have a cap 14D at a second end 14J thereof. The cap 14D is configured to fit within and cover the second end 14J, thereby providing a neat, finished appearance.

The surface of at least one of the telescoping members 14B includes graduated markings 14C to indicate the height of the net 12. The height of the net 12 is determined by reading the marking 14C which is just above a top end 21 of the sleeve 14A. The marking 14C which is above the top end 21 varies as the telescoping sleeve 14B is adjusted upward or downward within the sleeve 14A.

The scope of the present invention is not limited to the markings 14C shown in FIGS. 1 and 2. For example, the markings 14C may run from six feet to eight feet, instead of from six feet to nine and one half feet, as shown in FIG. 2; subsequently, the length of the telescoping member 14B may be shorter than indicated in the drawings. Any workable set of markings 14C is within the scope of the present invention.

A substantially rectangular plate 16 is disposed horizontally when the practice apparatus 10 is assembled and ready for use. The plate 16 supports the net support assemblies 14. Two cylindrically shaped sleeve holders 18 are attached to the plate 16 near distal ends of the plate 16, extending upwardly from the plate 16 when the practice apparatus 10 is assembled and ready for use. The sleeve holders 18 are configured to receive the lower end 20 of the sleeves 14A. The sleeves 14A are secured within the sleeve holders 18 via sleeve holder thumb screws 22.

The plate 16 is supported on a floor stand assembly 24. The floor stand assembly 24 includes two pipe shaped bent members 26, configured such that a first leg 26A of the bent member 26 extends upwardly toward the plate 16 and a second leg 26B of the bent member 26 extends along the floor 28, when the practice apparatus 10 is assembled and ready for use.

Two pipe shaped straight members 30 each have a first end 30A and a second end 30B. The first end 30A of each straight member 30 is smaller in diameter than the middle portion of the straight member 30 and is configured to snugly fit within the distal end of the second leg 26B of the bent member 26, and is held therein with a bent member thumb screw 32.

A pipe shaped double-bent member 34 has a substantially straight midsection, and is bent near each of its distal ends. The second ends 30B of the straight members 30 are smaller in diameter than the middle portion of the straight member 30 and are configured to snugly fit within the distal ends of the double-bent member 34, and are held therein with double-bent member thumb screws 36.

The plate 16 includes two cylindrically shaped first leg holders 38 which extend downwardly from the plate 16 at a declined angle with respect to the plate 16 when the apparatus 10 is assembled and ready for use. The first leg holders 38 are configured to receive the distal end of the first legs 26A of the bent members 26. The first legs 26A are secured within the first leg holders 38 via first leg holder thumb screws 40.

A substantially rectangular sand bag 42 contains sand (not shown) therein. The sand bag 42 hangs from the plate 16 via hooks 44 which are connected to the underside of the plate 16. The hooks are inserted through eyelets 46 disposed along an edge of the sand bag 42. The sand bag 42 provides stability to the practice apparatus 10.

The practice apparatus 10 may constructed of metal alloy or plastic.

Thus the sports practice apparatus of the present invention is easily assembled for use and disassembled for storage or transport, is made up of inexpensive components, and adjusts in height easily to vary the difficulty of making a shot, depending on the needs and abilities of the user.

While the above description contains many specific details, these should not be construed as limitations on the scope of the invention, but rather as an exemplification of one preferred embodiment thereof. Many variations are possible; for example:

a. the floor stand may be configured differently;

b. the sand bag may be deleted, and replaced with a floor stand of adequate size and weight to keep the practice apparatus safely standing;

c. the net may be attached to the net support assembly by other suitable means;

d. the plate may be shaped differently;

e. the plate may be deleted, and a different construction of the floor stand or the support assembly could serve the functions of the plate;

f. wheels may be mounted on the floor stand for ease of maneuvering about a floor; and g. the net support assembly may be configured differently, for example, a single telescoping member and sleeve could be used instead of two, with a horizontal ann near the top of the telescoping member for supporting the net.

Accordingly, the scope of the invention should be determined not by the embodiment illustrated, but by the appended claims and their legal equivalents.

The invention claimed is:

1. An apparatus for practicing basketball shots over a net, the net being stretched between two net support assemblies when the apparatus is assembled and ready for use, wherein:

a. the net support assemblies each comprise a sleeve and a telescoping member configured to slidingly fit within the sleeve;

b. a means for fixing the telescoping member at a plurality of positions within the sleeve;

c. a sleeve support means having a first attachment means for separably attaching the sleeves to the sleeve support means such that the sleeves and the telescoping members extend substantially upwardly from the sleeve support means when the apparatus is assembled and ready for use;

d. a floor stand assembly;

e. the sleeve support means having a second attachment means for separably attaching the floor stand assembly thereto.

2. The apparatus of claim 1, further including a weight means separably attachable to the sleeve support means to provide stability to the apparatus.

3. The apparatus of claim 1, wherein the floor stand assembly comprises:

a. two bent members configured such that a first leg of the bent member extends upwardly toward the sleeve support means and is separably attached thereto, and a second leg of the bent member extends along a floor when the apparatus is assembled and ready for use;

b. two straight members each having a first end and a second end, the first end configured to removably fit a distal end of the second leg of the bent member;

c. a connecting member configured to removably fit the second ends of the straight members at each end of the connecting member.

4. The apparatus of claim 3, wherein the first attachment means and the second attachment means are substantially hollow holders configured to receive the sleeves and the floor stand assembly respectively and to secure the sleeves and the floor stand assembly within the holders via screw means.

* * * * *